US005388798A

United States Patent [19]

Glick

[11] Patent Number: 5,388,798

[45] Date of Patent: Feb. 14, 1995

[54] EASEL FOR DISPLAYING CARDS AND THE LIKE

[76] Inventor: Isaac N. Glick, 7103-111 Street, Edmonton, Alberta, Canada, T6G 1G9

[21] Appl. No.: 262,398

[22] Filed: Jun. 20, 1994

Related U.S. Application Data

[63] Continuation of Ser. No. 716,504, Jun. 17, 1991, abandoned, which is a continuation-in-part of Ser. No. 360,598, Jun. 2, 1989, Pat. No. 5,058,850.

[51] Int. Cl.[6] ..... A47G 29/00

[52] U.S. Cl. ..... 248/459; 248/453

[58] Field of Search ..... 248/453, 441.1, 454, 248/157, 174, 459, 450

[56] References Cited

U.S. PATENT DOCUMENTS

| | | | |
|---|---|---|---|
| 591,089 | 10/1897 | Berkocker | 248/459 |
| 1,301,797 | 4/1919 | Zeegler | 248/174 X |
| 1,399,507 | 12/1921 | Mills | 248/459 |
| 1,439,719 | 12/1922 | Whepple | 248/459 |
| 1,555,429 | 9/1925 | Miller | 248/459 |
| 1,666,400 | 4/1928 | Rose | 248/459 |
| 2,832,176 | 4/1958 | Vergeer | 206/45.24 |

*Primary Examiner*—Alvin C. Chin-Shue

*Attorney, Agent, or Firm*—Millen, White, Zelane & Branigan

[57] ABSTRACT

The easel comprises a flat, generally diamond-shaped member formed of resilient, non-scratching material of limited flexibility. The member is scored to provide a line of weakness extending thereacross between its opposed oblique angle points. When bent along the line of weakness, the member adopts a two-sided pyramidal form. In this form, the member has rearwardly inclined, load-supporting front edges and bottom edges. The front edges form forwardly spaced and upwardly projecting hooks and slots close to their lower ends. The hooks function to suspend, retain and frictionally engage the lower edge of a generally flat item received in the slots to be displayed, such as a card, plate or the like. The sides of the easel member can be moved closer together or apart to vary the angle of inclination of the load-supporting edges, thereby varying the angularity of the displayed item. Frictional engagement between the hooks and the display item functions to prevent the side walls of the easel member from sliding apart when loaded.

3 Claims, 4 Drawing Sheets

EASEL FOR DISPLAYING CARDS AND THE LIKE

CROSS-REFERENCE TO RELATED APPLICATION

This application is a continuation of application Ser. No. 07/716,504, filed Jun. 17, 1991, abandoned, which application is a continuation-in-part of my application for U.S. Letters Patent Serial No. 07/360,598, filed Jun. 2, 1989, issued Oct. 22, 1991, Pat. No. 5,058,850.

FIELD OF THE INVENTION

This invention relates to an easel or display stand for displaying generally flat items such as cards, plates, books or the like. In its "knocked down" state, the easel is a flat plastic sheet; in its assembled state, it forms a pyramidal structure which will suspend the display item in an upright position.

BACKGROUND OF THE INVENTION

As stated, the present easel was developed for suspending a flat display item, such as a card, in an upstanding position.

In developing the easel, the following attributes were sought:

- that it should be flat in the knocked down state, for shipping;
- that it should suspend the display item above the support surface, so that the support surface will not be scratched by the displayed item;
- that the easel should be adjustable, so that the angularity of the display item can be varied;
- that the easel should have good footing and a good grip on the display item, so that the assembly is not easily overturned.

The following relevant prior art patents were noted in the prosecution of the parent of this application:

Wight in U.K. patent 113,330 teaches an easel which is flat in the knocked down state. The easel has triangular segments and is adapted to be bent along scored lines to form a pyramidal structure. As shown in FIGS. 3 and 4, the structure may have steps or projections extending forwardly at the base of its front edges, upon which the display card may rest.

Bird in U.S. Pat. No. 777,658 teaches a metal strip forming upwardly projecting hooks at each of its ends. The strip is bent into semi-circular form and a small display card may be inserted into the slots created by the hooks.

SUMMARY OF THE INVENTION

In accordance with the present invention, an easel is provided which comprises the following combination of features:

- it includes a generally diamond-shaped, flat easel member formed of resilient, stiff but still flexible, non-scratching material, the opposed side edges of the member being parallel;
- the easel member preferably has a line of weakness extending transversely thereacross between its oblique angle points, whereby the member may be easily bent along the line to form a generally pyramidal structure having open front and bottom sides, one pair of parallel side edges forming the base edges of the structure, the other pair forming rearwardly inclined, load-supporting front edges;
- each load-supporting edge forms a forwardly protruding hook-like member (hereafter also referred to as "hook") defining an upwardly opening slot. The hook is spaced above but close to the adjacent bottom edge of the easel member.

The hooks may define only narrow slots, for receiving a relatively thin display item. In this ease, the hooks are formed to frictionally engage the display item when the latter is inserted. The side walls of the pyramidal member may be brought together or spread apart, to adjust the verticality of the load-bearing edges—the frictional engagement of the hooks with the display item serves to fix the side walls in their adjusted position. In one particular embodiment, each hook is formed with a rearwardly projecting lobe for better contact with the display item.

Alternatively, the hooks may define wide slots for accommodating a relatively thick and heavy display item, such as a plate or book. In this case, a slotted cross-bar is used to lock up the side walls. Frictional engagement is usually not sufficient to keep the side walls from spreading when the easel member is loaded with the book or plate.

The structure described is characterized by the following when in use:

- The hooks function to prevent the supported upright display item from sliding downwardly and forwardly;
- The load is rearwardly inclined by resting against the front edges of the pyramidal member and its weight is transferred onto the strut formed along the bend line of the member;
- Tension is developed in the side walls of the easel member as the load is transmitted down through the strut of the easel member and the hooks, integral with the side walls, engage the base of the load item—this tension enables a structure constructed from a relatively flimsy flat sheet to support a relatively heavy load with surprising rigidity; and
- The tension created and the flexible nature of the material used enable frictional engagement to be used as the means for fixing the relative positioning of the easel sidewalls.

Broadly stated, the invention is an easel for use in supporting a substantially flat display item, comprising: a substantially diamond-shaped, flat easel member having opposed pairs of acutely and obliquely angled points and being formed of flexible yet stiff, resilient, non-scratching material, the opposed side edges being substantially parallel, whereby the easel member may be bent along a line between its oblique points to adopt a generally pyramidal configuration wherein the member has, in such pyramidal mode, substantially triangular side walls, load-supporting edges along one open side of the member and bottom edges along the other open side of the member, said load-supporting edges being rearwardly inclined, the front and bottom of the pyramidal easel member being open; upwardly protruding, substantially hook-like member forming an upwardly open slot, said hook-like member being spaced above but close to the adjacent bottom edge of the member, for receiving, suspending and restraining a display item inserted into the slots, said hook-like members and slots being formed so that the members will frictionally engage the display item; so that, in the loaded mode, the easel member supports the display item in a rearwardly inclined and upstanding position wherein the item extends into the slots and rests against the load-supporting edges, the hook-like members act to restrain the-item from slipping downwardly and forwardly and suspend the item above a support surface upon which the easel member stands, the joined side walls and hook-like members form a tensioned load-carrying structure when loaded with the display item and the hook-like members frictionally engage the display item to enable adjustment of the angular position of the display item.

DESCRIPTION OF THE PREFERRED EMBODIMENT

Figure 1:
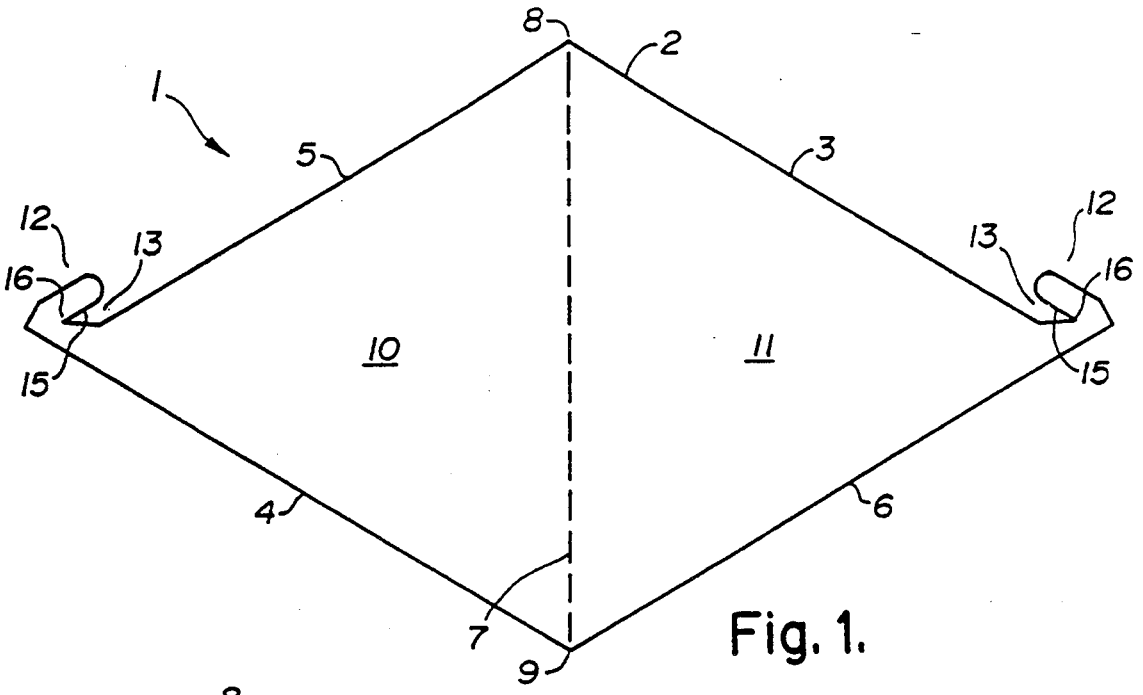
FIG. 1 is a top plan view showing an easel within "wedge" slots.

In the knocked-down state, the easel 1 comprises a flat, generally diamond-shaped member 2. This member 2 is formed of resilient, non-scratching material which has some flexibility but is still stiff. Typically the easel member 2 may have a thickness of 0.055 mm and may be formed of low impact polyethylene, by such as that sold under the trade-mark Polyblend the Polyblend Corporation of St. Charles, Ill.

The opposed side edges 3, 4 and 5, 6 of the easel member 2 are parallel. The side edges 3,5 are referred to as the load-supporting edges. The edges 4,6 are referred to as the bottom edges.

A line of weakness 7 extends transversely of the member 2 and connects the oblique angle points 8,9. The line of weakness 7 provides a hinge about which the triangular side walls 10, 11 may easily be bent to form it into the two-sided pyramidal configuration shown in FIGS. 2, 5, 7, 9. When the member 2 is so formed, the load-supporting edges 3,5 are rearwardly inclined at a small angle from vertical.

Adjacent its base, each load-supporting edge 3,5 forms a forwardly and upwardly projecting hook-like member 12. An upwardly open slot 13 is defined between the load-supporting edge 3 or 5 and the hook-like member 12. As shown, each hook-like member 12 is spaced above the adjacent bottom edge 4 or 6. Thus the display item 14, when inserted into the slots 13, is suspended above the support surface (not shown), such as that of a table upon which the easel 1 sits.

Figure 3:
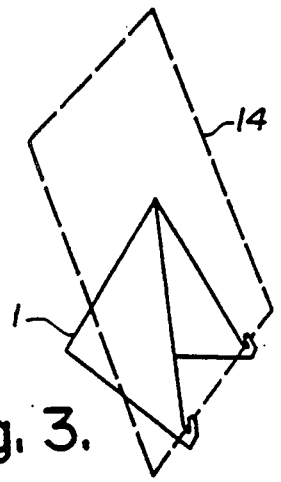
FIG. 3 is a perspective view showing the easel of FIG. 2 supporting a display card.

When the display item 14 is inserted into the slots 13, there is frictional engagement between the rear edges 15 of the hook-like members 12 and the item, in the cases of the easels shown in FIGS. 1 and 3. If the side walls 10, 11 are spread apart or brought together within the usual range of movement, this frictional engagement functions to fix the positions of the side walls 10, 11 (although this is not so when the side walls are spread far apart or pressed close together).

Figure 2:
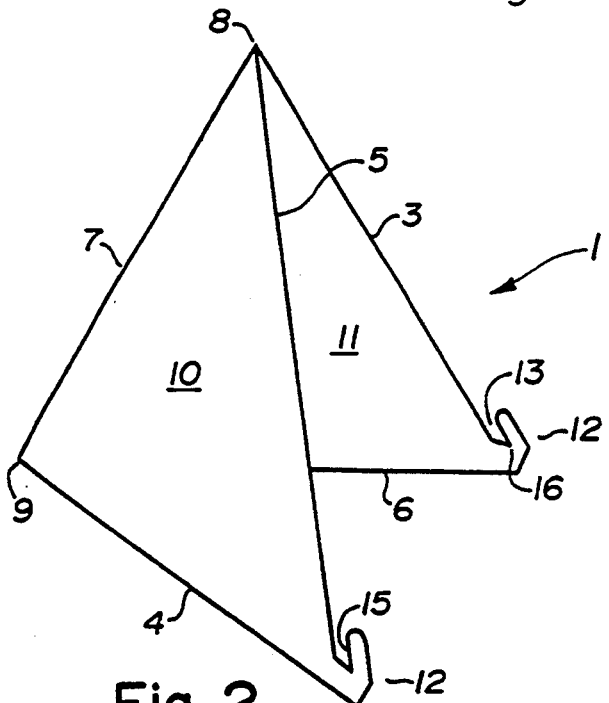
FIG. 2 is a perspective view showing the easel of FIG. 1 in the pyramidal mode.
Figure 4:
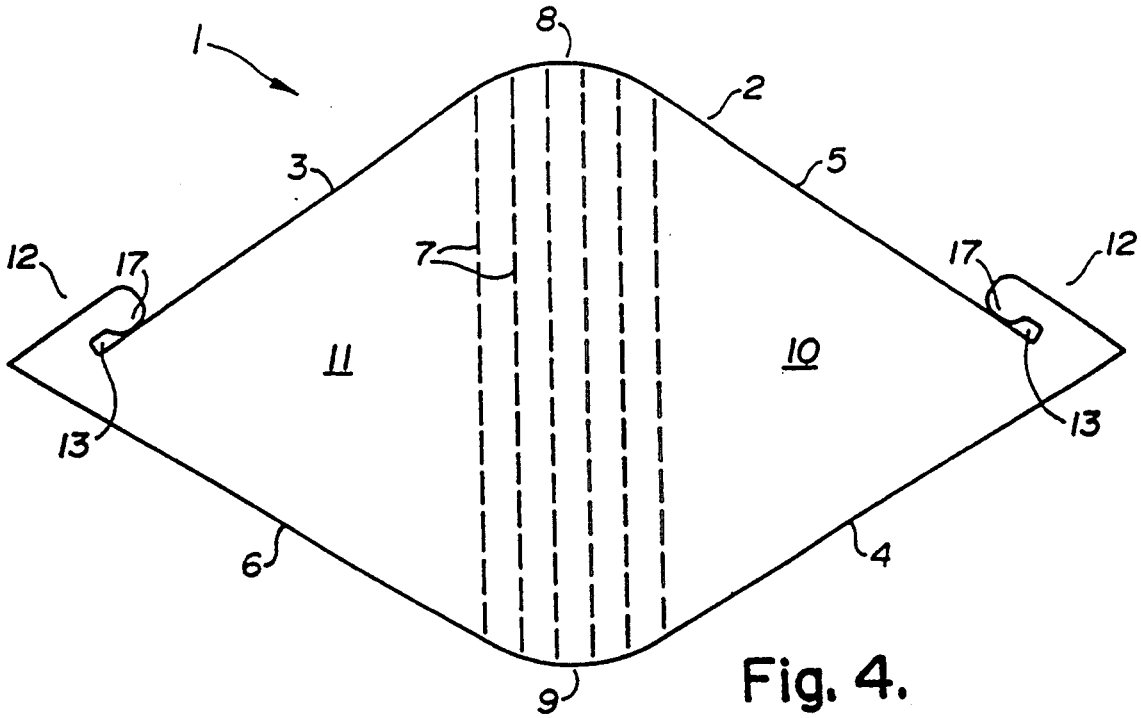
FIG. 4 is a top plan view of an easel having a hook member that curls back to contact the front load-supporting edge, said easel having a plurality of spaced apart lines of weakness so that the bend takes a rounded form.
Figure 5:
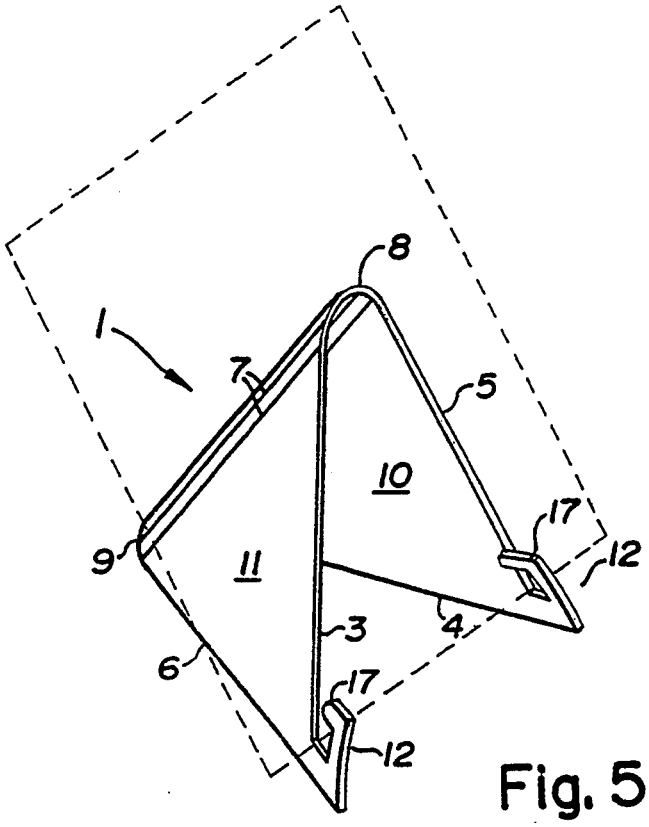
FIG. 5 is a perspective view showing the easel of FIG. 4 in the pyramidal mode.

The slot 13 may take various forms. In FIGS. 1 and 2, the slot has a width of about ¼ inch and a downwardly directed, wedge-shaped bottom corner 16. Due to its width, the slot 13 is adapted to receive a thick display item 14, such as a photograph having a foamed plastic backing. However, if a thin display item 14, such as a card, is inserted, it drops into the corner 16 and frictional engagement with the hook-like members 12 is still obtained. In FIGS. 4 and 5, the hook-like members 12 are shaped to have their tips 17 extend rearwardly in the form of lobes to touch the load-bearing edges 3,5. Yet the slot 13 is relatively wide at its root. When a display item 14 is inserted into the slot, the hook-like member tips 17 flex to the side to allow insertion. The tips 17 frictionally engage the display item with a firm contact.

Figure 6:
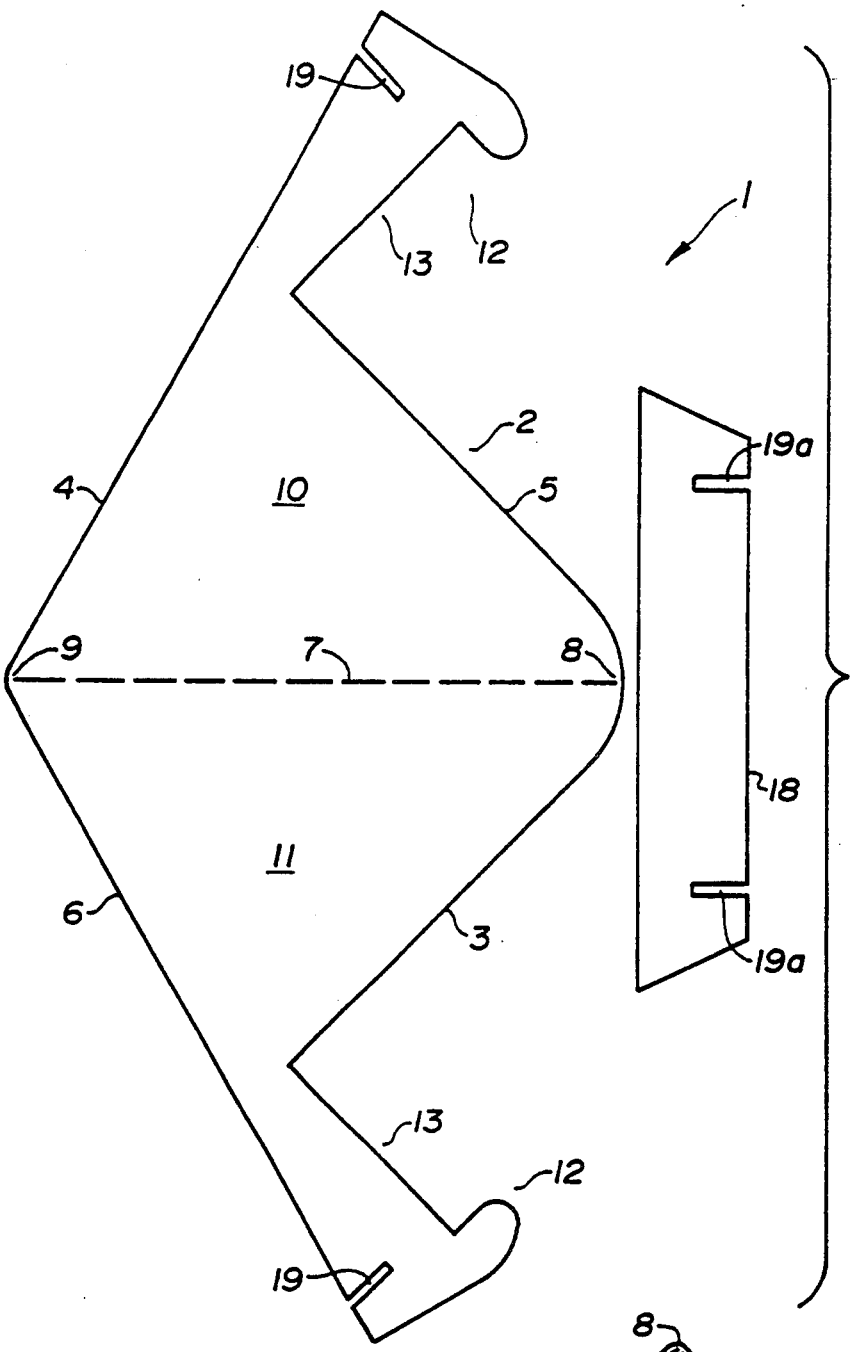
FIG. 6 is a top plan view showing an easel, for supporting a thick item such as a book, together with a cross-bar for locking the side walls in a fixed position.
Figure 7:
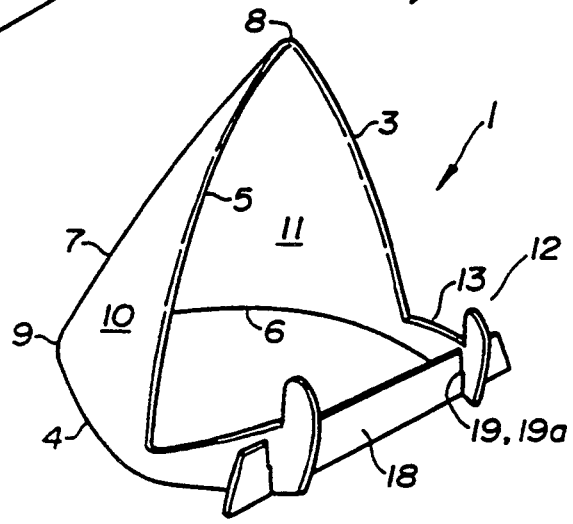
FIG. 7 is a perspective view showing the easel and cross-bar of FIG. 6, in the pyramidal mode.
Figure 8:
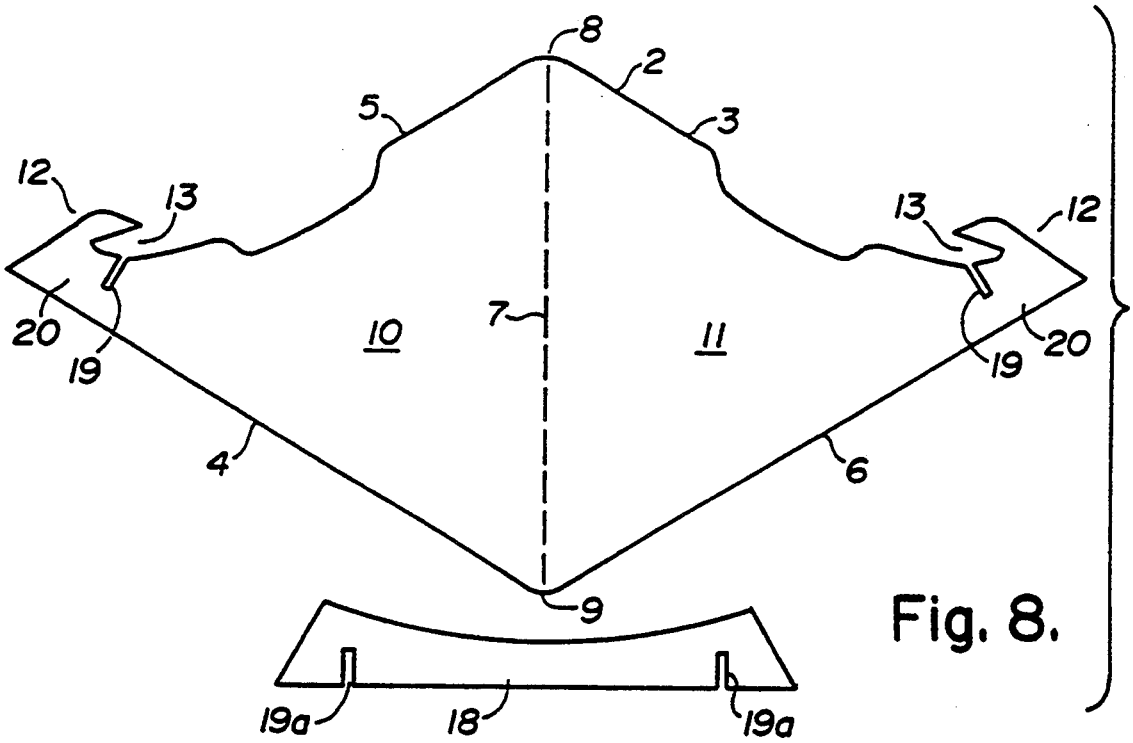
FIG. 8 is a top plan view showing an easel and cross-bar for supporting a plate.
Figure 9:
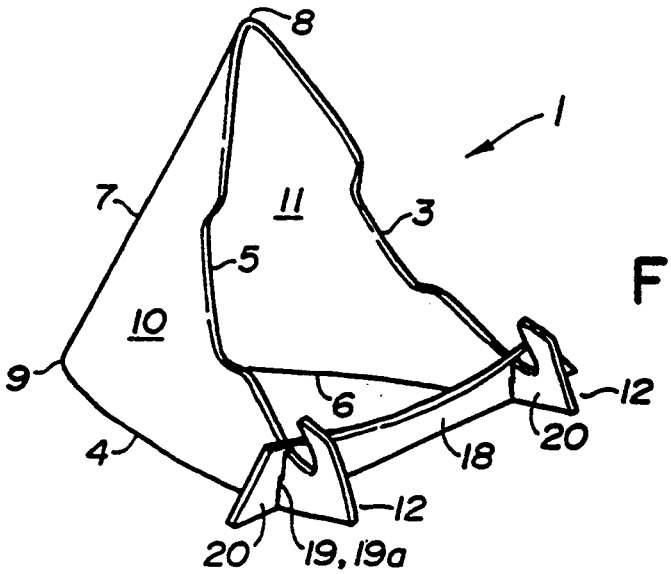
FIG. 9 is a perspective view showing the easel and cross-bar of FIG. 8 in the pyramidal mode.

The embodiment illustrated in FIGS. 6, 7 is designed for use with relatively thick items 14, such as a book. The hook-like members 12 are fixed in a laterally spaced apart position by the slotted cross-bar 18, which engages slots 19 formed in the shanks 20 of the hook members 12, as shown. A similar easel 1 is shown in FIGS. 8, 9 for use in displaying plates.

In use, the display item 14 is inserted into the slot 13. The item 14 leans against the rearwardly inclined load-supporting edges 3,5 and load is applied to the pyramidal easel member 2. The hook-like members 12 suspend the item above the support surface and restrain it against slipping off the easel member 2. As load is applied to the hook-like members 12, the easel member 2 is tensioned to create a strong, rigid stand. In the case of the embodiments of FIGS. 1–5, the side walls 10, 11 can be adjusted together or apart to alter the angle of the load-supporting edges 3,5 and the frictional engagement between the hook-like members 12 and the display item 14. In the case of the embodiments of FIGS. 6–9, the cross-bars 18 preclude infinite adjustment of the side walls 10, 11, however a plurality of slots 21 may be provided in the cross-bar to provide a plurality of adjusted spacings of the side walls.

The invention is characterized by the following advantages:

- simplicity—the easel is easy to assemble and use;
- security—the easel has spaced footing and a firm grip on the display item;
- economy—one size of easel can be used with display items of varying proportions;
- portability—the easel may be shipped and stored flat;
- adjustability—the display angle can be varied;
- scratch-proof—the displayed item is suspended out of contact with the support surface by an easel made of non-scratching material; and
- strength—the tensioned plastic easel can safely support a surprisingly heavy load.

The embodiments of the invention in which an exclusive property or privilege is claimed are defined as follows:

1. An easel for use in supporting a substantially flat display item, such as a photograph or the like, comprising:

a substantially diamond-shaped, flat easel member having opposed pairs of acutely and obliquely angled points and being formed of flexible yet stiff, resilient, non-scratching material, the opposed side edges being substantially parallel, whereby the easel member may be bent along a line between its oblique points to adopt a generally pyramidal configuration wherein the member has, in such pyramidal mode, substantially triangular side walls, load-supporting edges along one open side of the member and bottom edges along the other open side of the member, said load-supporting edges being rearwardly inclined, the front and bottom of the pyramidal easel member being open;

each load-supporting edge having a forwardly and upwardly protruding, substantially hook-like member forming an upwardly open slot, said hook-like member being spaced above but close to the adjacent bottom edge of the member, for receiving, suspending and restraining a display item inserted into the slots, said hook-like members and slots being formed to deflect upon insertion of the display item so that the hook members bare against and frictionally engage the display item to positively restrain the display item against the load supporting edges;

so that, in the loaded mode, the easel member supports the display item in a rearwardly inclined and upstanding position wherein the item extends into the slots and rests against the load-supporting edges, the hook-like members act to restrain the item from slipping downwardly and forwardly and suspend the item above a support surface upon which the easel member stands, the joined side walls and hook-like members form a tensioned load-carrying structure when loaded with the display item and the hook-like members frictionally engage the display item to enable adjustment of the angular position of the display item.

2. The easel as set forth in claim 1 wherein:

the slot formed by each hook-like member has a wedge-shaped configuration at its forward lower end.

3. The easel as set forth in claim 1 wherein:

each hook-like member has a rearwardly projecting lobe at its upper end which is deflected in order to receive the display item in the slot, the rearwardly projecting lobe having a rear edge for baring against the display item.

* * * * *